United States Patent [19]

Smith

[11] 4,251,323

[45] Feb. 17, 1981

[54] METHOD FOR CALCINING DELAYED COKE

[75] Inventor: John H. Smith, Ponca City, Okla.

[73] Assignee: Conoco, Inc., Ponca City, Okla.

[21] Appl. No.: 30,251

[22] Filed: Apr. 16, 1979

[51] Int. Cl.³ ..... C10B 49/06

[52] U.S. Cl. ..... 201/29; 201/34; 201/37; 202/121

[58] Field of Search ..... 201/28, 29, 34, 37, 201/25, 36; 202/99, 120, 121, 221, 215; 432/13, 96 (U.S. only)

[56] References Cited

U.S. PATENT DOCUMENTS

| | | | |
|---|---|---|---|
| 1,671,673 | 5/1928 | Doerschuk et al. | 201/36 X |
| 2,716,628 | 8/1955 | Weikart | 201/25 X |
| 2,738,316 | 3/1956 | Metrailer | 201/36 X |
| 2,757,129 | 7/1956 | Reeves et al. | 201/34 X |
| 2,796,390 | 6/1957 | Elliott | 201/34 |
| 2,982,701 | 5/1961 | Scott, Jr. | 201/34 X |
| 3,086,923 | 4/1963 | Destremps et al. | 201/28 X |
| 3,173,852 | 3/1965 | Smith | 201/28 X |
| 3,823,073 | 7/1974 | Minkkinen | 201/25 |
| 4,066,420 | 1/1978 | Danguillier et al. | 201/28 X |

*Primary Examiner*—Frank W. Lutter
*Assistant Examiner*—Roger F. Phillips
*Attorney, Agent, or Firm*—Richard W. Collins

[57] ABSTRACT

Delayed petroleum coke is calcined in an internally-fired vertical shaft kiln. A downwardly-moving bed of green coke is preheated in the top of the kiln by rising combustion gases, then heat soaked at calcining temperatures in the intermediate section of the kiln, and finally cooled by recycle gas moving upwardly from the lower part of the kiln. Partially cooled calcined coke is recovered from the bottom of the kiln.

4 Claims, 2 Drawing Figures

METHOD FOR CALCINING DELAYED COKE

BACKGROUND OF THE INVENTION

This invention relates to calcination of particulate carbonaceous material such as delayed petroleum coke. Delayed petroleum coke is generally calcined at high temperature to drive off volatile hydrocarbons and moisture. The calcined product may be used to produce anodes for aluminum manufacture, and in cases where the delayed coke is premium type coke, it is used for manufacture of graphite electrodes useful in the electric arc steel-making process.

Most present-day commercial coke calciners are inclined rotary kilns. The operation of this type of rotary calciner is described in U.S. Pat. Nos. 4,022,569 and 4,053,365.

Vertical shaft kilns have been used for calcining coke. British Pat. No. 770,930 and U.S. Pat. No. 3,433,713 describe externally-fired gravity-flow shaft kilns for calcining coke. These kilns include burners which heat the exterior of the calciner.

An internally-fired vertical calcining kiln is described in U.S. Pat. No. 3,823,073. This patent described a process in which the coke is calcined in a free-fall zone for a very short time period.

A vertical kiln which is heated by electrical resistance heating is described in U.S. Pat. No. 1,671,673.

A calcining process in which coke and oxidant are moved cocurrently through a vertical retort is described in U.S. Pat. No. 3,271,268.

Numerous U.S. patents describe vertical retorts for distilling oil from shale, and include use of recycle gas for cooling retorted product, air injection to provide an internal combustion zone, and use of combustion gas to preheat the feed. Exemplary of these U.S. Pat. Nos. are 2,560,767; 2,901,402; 3,297,562; 3,499,834 and 3,526,586. Additional U.S. Pat. Nos. showing shale retorting in internally-fired vertical furnaces include 2,813,823; 3,464,913; 3,619,405 and 4,066,529.

Processes for desulfurization of petroleum coke by passing the coke through heating, soaking and cooling zones are described in U.S. Pat. Nos. 2,716,628 and 2,789,085.

A process for making metallurgical coke for use in blast furnaces from a coking coal using a shaft kiln is described in U.S. Pat. No. 4,002,534.

None of the above references shows a process or apparatus for calcining delayed petroleum coke in an internally-fired vertical shaft kiln utilizing a downwardly moving bed of particulate coke and a countercurrent gas flow.

SUMMARY OF THE INVENTION

According to the process of the present invention, particulate carbonaceous material such as delayed petroleum coke is calcined in an internally-fired vertical shaft kiln. A moving bed of the particulate material flows downwardly through the kiln and is preheated to calcining temperature and substantially devolatilized in an upper section by hot gases moving upwardly through the kiln. Combustion air or oxygen-enriched air is introduced into a combustion zone where combustible components of a recycle gas, as well as some of the particulate material, are burned. Combustion gases plus unburned recycle gas heat the downwardly moving bed of material at calcining temperatures in a calcining zone. These gases preheat the incoming particulate material above the calcining zone. Kiln off gases containing fines and volatile material in the form of vapor and/or mist are subjected to fines removal and scrubbing, providing a low heat value product gas. A portion of this product gas is injected into the lower part of the kiln as recycle gas. The upwardly moving recycle gas cools the calcined material from the combustion zone so that the calcined product leaving the kiln can be readily handled.

The apparatus of this invention includes a vertical shaft kiln having an air distributor which is protected by a circulating cooling fluid. The apparatus also includes means for cleaning and cooling off gases and recycling them to the kiln, as well as means for providing uniform flow through the filn.

DESCRIPTION OF THE PREFERRED EMBODIMENT

There are inherent advantages is calcining delayed petroleum coke in a vertical shaft kiln. One important advantage is that the internally fired shaft kiln does not require any added fuel, whereas the conventional rotary kiln calcining process requires the addition of a large amount of fuel. Another significant advantage is that the heat losses from a shaft kiln are much lower than those from a rotary kiln.

As noted in the discussion of the prior art, numerous attempts have been made to calcine delayed petroleum coke in shaft calciners. However, calcining petroleum coke in a shaft kiln is not without its problems. Calcining of petroleum coke, as contrasted to retorting of oil shale, requires very high temperatures such as above 2000° F., and preferably above 2400° F. In order to attain such temperatures uniformly in a large shaft kiln, it is necessary to provide heat uniformly through the cross section of the kiln. Attempts to calcine petroleum coke in shaft kilns have been made utilizing externally fired kilns wherein the heat is generated in an annulus outside the coke-containing vessel. This is not practical with a large commercially sized operation because of heat transfer problems. Attempts to calcine petroleum coke in electrically heated furnaces have also been unsuccessful on a commercial basis. Thus, in order to utilize the advantages of a shaft kiln on a large scale operation, it is necessary to use an internally fired kiln in which air is injected into an intermediate section of the kiln for combustion of recycle gas and coke to provide the necessary heat. The primary problem with developing an internally fired shaft kiln for calcining petroleum coke is in the provision of an air distributor which will tolerate the high temperatures necessary. Merely using a metal pipe grid such as is done in retorting of oil shale is not satisfactory, as the metals will not support the load of the coke bed at the temperatures involved.

Another problem associated with the operation of a shaft kiln is that of fine particles in the kiln off gas. At least a portion of this off gas must be recycled to the lower part of the kiln to cool the calcined coke and to provide control of the process, and unless provision is made to remove fines from this gas stream, the fines will cause problems in the gas handling equipment.

Still another problem in calcining petroleum coke in a shaft kiln is that of refluxing of heavy oils volatilized from the coke. If this volatilized material condenses in the upper part of the kiln, undesirable refluxing of heavy oils in the kiln will result.

Still another problem is that of assuring uniform flow through the kiln. Without uniform flow, channelling and inconsistent calcining would cause the operation to be unsatisfactory.

The present invention provides a method and apparatus whereby the advantages of a shaft kiln calcining operation can be obtained in spite of the numerous difficulties inherent in such an operation.

Figure 1:
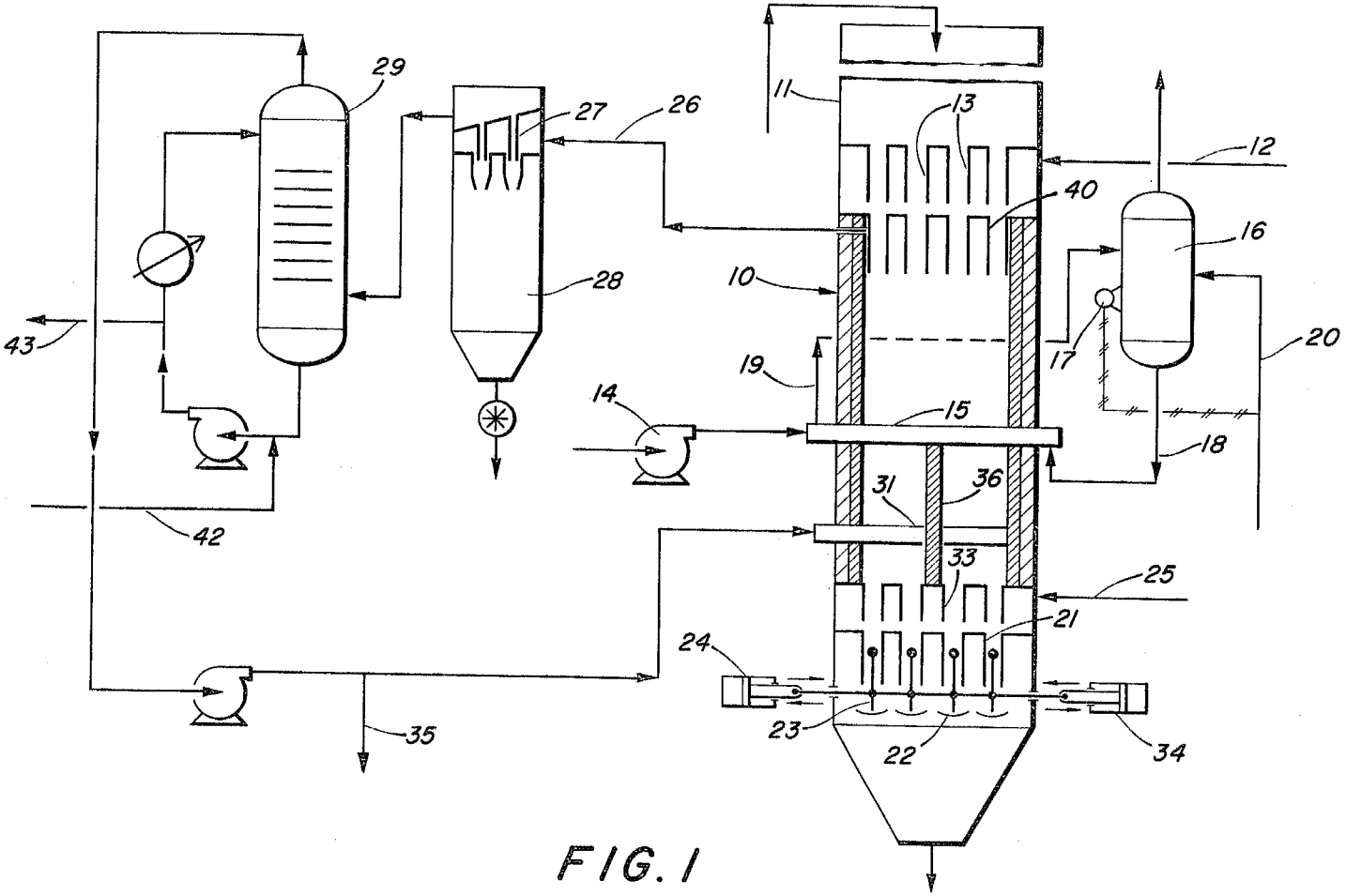
FIG. 1 is a schematic flowsheet illustrating the process and apparatus of the invention.

Apparatus in accordance with the invention is illustrated schematically in FIG. 1. A vertical shaft kiln shown generally at 10 is provided with a feed hopper 11. Seal gas line 12 is provided for injection of seal gas between feed hopper 11 and the top of kiln 10. Upper feed inlet spouts 13 and lower feed inlet spouts 40 distributed uniformly about the cross section of the kiln are provided for transferring green petroleum coke from feed hopper 11 to the interior of the kiln. An air blower 14 provides combustion air to the interior of the kiln through air distributor 15. Air distributor 15 is preferably a series of parallel jacketed and insulated conduits to be described in more detail below. Cooling fluid for the air distributor jacketing circulates from fluid reservoir 16. Preferably, cooling fluid reservoir 16 includes a liquid level control 17, inlet line 18, cooling fluid return line 19, and makeup fluid line 20. The cooling fluid system may be a thermal siphon utilizing water as the cooling fluid, or alternatively may be a forced circulation system.

The lower part of kiln 10 includes a plurality of upper discharge spouts 33 uniformly dispersed about the cross section of the kiln for uniformly withdrawing calcined coke therefrom. The calcined coke then flows through lower discharge spouts 21 which are positioned above discharge trays 22. Wiper blades 23 actuated by pistons 24 and 34 remove the coke from trays 22 uniformly to maintain uniform flow from the kiln. Lower seal gas line 25 is provided for injection of seal gas between the lower discharge spouts 21 and the kiln. Cooled calcined product is withdrawn from the bottom of the kiln.

Kiln off gas line 26 extends to fines removal cyclones 27 which discharge fines into bin 28. Fines-free off gas then passes to scrubber 29 where the gas is cooled and condensable hydrocarbons are removed. The cleaned and cooled off gas from scrubber 29 is partially removed through line 35 as a low heat value product gas. The remaining off gas is returned as recycle gas to the lower part of kiln 10 through recycle gas distributor 31.

The hydrocarbons condensed in scrubber 29 are very heavy and viscous. Light cycle oil or other diluent is fed to scrubber 29 through line 42 to dilute the heavy condensed hydrocarbons. The resulting solution of condensed hydrocarbons and diluent is withdrawn through line 43 and may be used for fueling steam boilers or process heaters.

The air distributor 15 preferably comprises a manifold (not shown) feeding a series of parallel conduits extending across the kiln interior and having spaced air outlet nozzles along their lengths. The conduits preferably are jacketed to provide a path for cooling fluid and have stiffening members inside the jackets to provide the strength to support the conduits across the span of the kiln and to support the weight of the bed of coke moving through the kiln. The conduit jackets should be provided with a considerable thickness of refractory insulation to minimize heat losses into the conduit jackets. The number of conduits and air outlet nozzles depends primarily on the size of the kiln. For a commercial kiln having an inside diameter of thirty feet, about twelve conduits each having horizontally directed outlet nozzles at one foot intervals on both sides might be utilized.

The extremely high temperatures and the load of the moving coke bed make it desirable, for a large kiln, to provide intermediate support to the conduits. One manner of providing this support is to place an intermediate support wall 36 between the bottom of kiln 10 and air distributor 15. This wall 36 may extend across a diameter of the kiln, and since the rising recycle gas will cool the coke shortly after it leaves the combustion zone around the air distributor 15, support wall 36 may include metal reinforcing throughout all but the uppermost part thereof. Alternatively, support wall 36 may be a steel structural member up to the topmost section thereof, which must be of refractory material due to the temperatures at and near the air distributor.

Kiln 10 should be of uniform or increasing cross sectional area from top to bottom to facilitate uniform flow of the bed and to prevent plugging.

The operation of a shaft kiln and its associated units in accordance with the invention will now be described.

Green delayed petroleum coke is fed on a batch or a continuous basis to feed hopper 11. Once suitable operating conditions have been established in the kiln, the product discharge apparatus, including pistons 24 and 34 which actuate wiper blades 23, is started, and a moving bed of coke flows through the calciner at a rate dependent upon the rate of operation of the discharge apparatus. The preferred rate of flow through the kiln is from 1 to 2 tons per dry day (dry basis) of green coke per square foot of kiln cross section. Combustion air (or oxygen-enriched air) from blower 14 is distributed uniformly through air distributor 15 in an intermediate section of the kiln. To obtain the higher temperatures, such as above 2600° F., it may be expedient to utilize oxygen-enriched air conditioning up to about 40 volume percent oxygen. The amount of air injected is between 20 and 60 pound mols per ton of dry green coke, and preferably between 25 and 40 pound mols per ton of dry green coke. At lower air rates, the off gas temperature would be so low that refluxing of volatilized hydrocarbons or cyclone fouling might interfere with the operation. Also, as will be discussed in detail below, at lower air rates the calcining temperature becomes very sensitive to recycle gas rates such that a small change in recycle gas rate causes a large variation in calcining temperature. However, each mol of air fed to the kiln burns several pounds of coke, so there is an incentive for maintaining the air rate at a reasonably low level. Also, at excessive gas flow rates, the amount of entrained fines in the off gas increases.

In order to obtain a satisfactorily calcined product, it is essential that the green coke be subjected to a calcining temperature of at least 2000° F. for a period of at least one hour. The calcining may take place at a temperature of from 2000 to 3000° F. for a period of 1 to 10 hours. Preferably, the green coke is subjected to temperatures above 2400° F. in a soaking zone for at least two hours, and in some cases, particularly where the green coke has a high sulfur content, a temperature above 2600° F. for at least two hours is desirable. Most preferably, the coke is calcined at a temperature of from 2400° to 2800° F. for a period of 2 to 5 hours.

The kiln off gas comprises combustion products, volatilized material, and other gases produced during the calcining operation. In order to avoid hydrocarbon refluxing and to avoid problems in the fines removal equipment, the off gas temperature should be maintained between 300° and 1100° F., and preferably between 500° and 800° F. In any event, it should be maintained above the hydrocarbon dew point of the off gas. The amount of cleaned and scrubbed recycle gas returned to recycle distributor 31 should be from 80 to 120 (preferably 85 to 110) pound mols per ton of dry green coke feed. This amount of recycle gas assures that the heat capacity of the recycle gas will exceed the heat capacity of the calcined coke leaving the combustion zone such that the calcined coke is cooled to a temperature approaching the recycle gas inlet temperature a short distance below air distributor 15. This rate of recycle gas also assures that the incoming coke will be heated to near the calcining temperature very soon after it enters the calciner. This provides a maximum heat soaking time at calcining temperatures for the green coke moving through the kiln. This also minimizes the chances of hydrocarbon refluxing within the kiln.

Air distributor 15, as shown in FIG. 1, is cooled by circulating fluid from reservoir 16 which provides a thermal siphon effect wherein a cooling liquid, preferably water, flows from reservoir 16 through inlet line 18 into distributor 15. The water is partially vaporized as it moves through cooling jackets around the air distributor pipes, and the resulting lower density of combined water and steam in return line 19 assures a continuous flow of cooling fluid through the distributor. Steam may be vented or used as process steam, and makeup water from line 20 is added as needed by operation of level controller 17.

Green coke feed rates of from 0.5 to 2.5 tons per day per square foot of kiln cross section may be utilized. Normally, a rate of from 1 to 2 tons per day per square foot of kiln cross section will be transferred. The fines removed from the kiln off gas are collected in bin 28 and may be mixed with green coke feed and returned to the kiln. Recycle gas leaving scrubber 29 should be maintained above its dew point with respect to water to avoid having an oil and water mixture in scrubber 29. The recycle gas will contain a significant amount of hydrogen which is produced during the calcining, and this hydrogen, generally above 15 percent, provides a reducing atmosphere which is beneficial in reducing the sulfur content of the coke.

Seal gas introduced at the top and bottom of the kiln should be a low oxygen content gas such as a flue gas or other gas containing no more than about 3 volume percent oxygen.

Figure 2:
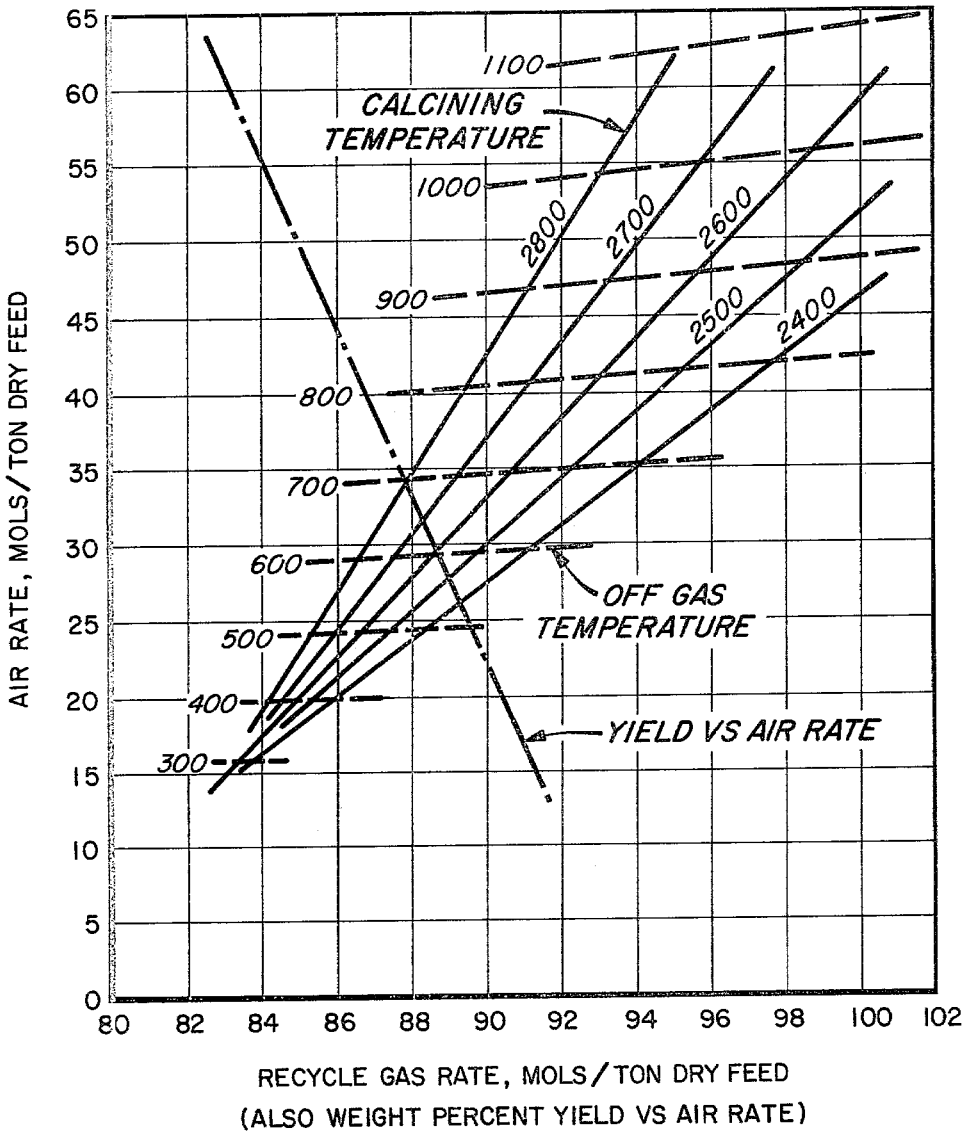
FIG. 2 is a chart illustrating the performance of the process at specific operating conditions.

The chart in FIG. 2 illustrates the relationship of combustion air rate and recycle gas rate to calcining temperature and off gas temperature. The chart also shows the relationship of coke yield versus air rate. The chart is based on a coke feed containing 6 percent volatile matter and 8 percent by weight water on a dry basis, total radiation losses of 102,000 Btu/ton dry feed, total seal gas inleakage of 7 mol/ton dry feed, and air and recycle gas inlet temperatures of 200° F. As mentioned earlier, it is desirable for the feed coke to be heated to near maximum temperature in the upper part of the bed. The desired shallow preheating-devolatilization zone should be followed by a relatively deep high temperature soaking zone that extends downward to the air distributor level. The temperature in this high temperature soaking zone is relatively constant throughout. To achieve this desirable temperature profile through the upper section of the kiln, it is necessary that the total gases rising through the soaking zone have a heat capacity at least equal to that of the descending coke at full calcining temperature. The preferred coke temperature profile in the cooling zone between the air inlet and the recycle gas inlet is a very rapid drop immediately below the air inlet level to near the recycle gas inlet temperature, with little further cooling through the rest of the kiln. To achieve this temperature profile in the cooling zone, it is necessary that the heat capacity of the rising gases from the recycle gas inlet to the air inlet reasonably exceed the heat capacity of the descending coke. To provide a 10 percent excess heat capacity for the gas stream, the gas, comprised of recycle plus bottom seal gas inleakage, should have a flow rate of not less than 100 pound mols per ton of product coke at a calcining temperature of 2400° F. and not less than 103 pound mols per ton of product coke at a calcining temperature of 2800° F. These figures are for a typical calculated off gas composition, although the numbers are relatively insensitive to gas composition as the heat capacity per pound mol is relatively constant even with changing gas compositions.

From FIG. 2, it is apparent for the desired practical air and recycle gas rates for the desired operating conditions are within rather narrow ranges. At an air inlet rate below 25 pound mols per ton of coke, the off gas temperature is so low that refluxing or cyclone fouling may become a problem. Also, at the lower air rates, calcining temperature becomes very sensitive to recycle gas rate, which causes a wide variation in calcining temperature with a relatively small variation in recycle gas rate. To illustrate the use of a graph such as that in FIG. 2 in controlling a shaft kiln, it can be seen that for a specific selected calcining temperature and off gas temperature, the air and recycle gas rates can be readily determined. For example, for a calcining temperature of 2400° F. with an off gas temperature of 550° F., it can be seen that the air and recycle gas rates are 27.3 and 89.8 pound mols per ton of dry coke feed respectively. If it is desired to increase the calcining temperature to 2700° F. and the off gas temperature to 650° F., it can be seen that the air rate should be increased to 31.7 and the recycle gas rate decreased to 88.3. While the chart in FIG. 2 is for a specific set of conditions utilizing various assumptions regarding heat losses from the kiln, the principle of controlling kiln conditions by control of combustion air rate and recycle gas rate relative to coke feed rate is demonstrated such that in actual operation an operator could easily adjust conditions to obtain the desired temperature profile by referring to a chart such as shown in FIG. 2. FIG. 2 also shows a line indicating the weight percent yield versus the combustion air rate. This line reflects the additional coke losses due to increased burning of coke with increasing air rates.

The process and apparatus of this invention provide, for the first time, for calcining of green delayed petroleum coke in an internally-fired vertical shaft kiln on a commercial scale. A kiln having a diameter of 30 feet or more can be operated free of plugging and refluxing problems and can provide a uniformly calcined product.

I claim:

1. A process for calcining delayed petroleum coke in an internally-fired vertical shaft kiln comprising:

(a) feeding particulate green delayed petroleum coke at a rate of from 0.5 to 2.5 tons per day per square foot of kiln cross section into the top of a vertical shaft kiln to form a downwardly-moving bed of material to be calcined;

(b) introducing combustion air in an amount of from 20 to 60 mols per ton of dry green coke feed into an intermediate level of said kiln to provide a combustion zone and to generate heat by internal burning;

(c) recovering an off gas stream comprised of internally-generated flue gas and volatile material released from said coke from the upper section of said kiln, the temperature of said off gas being from 300° to 1100° F.;

(d) introducing recycle gas comprising a portion of said off gas stream in an amount of from 80 to 120 mols per ton of dry green coke feed into the lower section of said kiln for upward movement therethrough for recovering heat from coke below the combustion zone and for returning said heat to coke in and above the combustion zone;

(e) controlling the rates of recycle gas introduction, combustion air introduction and green coke feed to provide a calcining temperature of at least 2000° F. for a period of at least one hour for the coke moving therethrough and to maintain the temperature of the off gas leaving said kiln above its hydrocarbon dew point; and (f) recovering partially cooled calcined coke from the bottom of said kiln.

2. The process of claim 1 wherein the rates of recycle gas introduction, combustion air introduction and green coke feed are regulated to provide a soak time of at least 2 hours at temperatures above 2400° F. for the coke moving through the kiln.

3. The process of claim 1 wherein the coke passing through said kiln is maintained at a temperature above 2600° F. for at least 2 hours.

4. The process of claim 1 wherein the green coke feed rate is from 1.0 to 1.5 tons per day per square foot of kiln cross section, the combustion air introduction rate is from 25 to 40 mols per ton of dry green coke feed, the recycle gas rate is from 85 to 100 mols per ton of dry green coke feed, the coke moving through the kiln is maintained at a calcining temperature of from 2400° to 2800° F. for a time of from 2 to 5 hours, and the temperature of the off gas leaving the kiln is from 500° to 800° F.

* * * * *